US007736096B1

(12) United States Patent
Aaron

(10) Patent No.: US 7,736,096 B1
(45) Date of Patent: Jun. 15, 2010

(54) MODULAR INTERLOCKING RETAINING WALL/SEAWALL HAVING REDUCED INSTALLATION TIME

(76) Inventor: Albert E. Aaron, 9435 Royal Palm Ave., New Port Richey, FL (US) 34654

( * ) Notice: Subject to any disclaimer, the term of this patent is extended or adjusted under 35 U.S.C. 154(b) by 0 days.

(21) Appl. No.: 11/860,048

(22) Filed: Sep. 24, 2007

(51) Int. Cl.
*E02D 29/00* (2006.01)

(52) U.S. Cl. ..... 405/284; 405/286

(58) Field of Classification Search ..... 405/18–21, 405/284, 285, 286, 287, 28, 107, 218
See application file for complete search history.

(56) References Cited

U.S. PATENT DOCUMENTS 3,747,353 A * 7/1973 Monahan ..... 405/284
4,324,508 A * 4/1982 Hilfiker et al. ..... 405/284
4,804,299 A * 2/1989 Forte et al. ..... 405/285
4,992,005 A * 2/1991 Hilfiker ..... 405/284
5,368,416 A * 11/1994 Cataldo ..... 405/285
5,492,438 A * 2/1996 Hilfiker ..... 405/285
5,533,839 A * 7/1996 Shimada ..... 405/284
5,538,363 A * 7/1996 Eastwood ..... 405/262
5,697,736 A * 12/1997 Veazey et al. ..... 405/284
6,431,797 B2 * 8/2002 Greenberg ..... 405/284
2004/0052588 A1 * 3/2004 Keshmiri ..... 405/284

* cited by examiner

*Primary Examiner*—David J Bagnell
*Assistant Examiner*—Benjamin Fiorello
(74) *Attorney, Agent, or Firm*—Ronald E Smith; Smith & Hopen, P.A.

(57) ABSTRACT

A seawall is formed of concrete modules that are laterally disposed relative to one another and interlocked to one another at their abutting end walls. Each module has a base that overlies a support surface and an upstanding sea-retaining wall disposed perpendicular to the base, forming an inverted "T" and having no brace walls. The sea-retaining wall has a front surface facing a body of water and a back surface facing land. The seawall is formed by a mold that includes a base having a generally parallelepiped configuration and a pair of slightly inclined mold walls for forming the sea-retaining wall of the module. A first embodiment includes a steel mold. A second embodiment includes an aluminum mold having parts that open along hinge lines and which require reinforcement dowels to prevent pressure-induced bulges.

5 Claims, 15 Drawing Sheets

32b
40
60
82
80
93
38
32
93
65b
52
65a
93
64
70
66
68
38a
32a
13
34
34
34
34
34
34
72
74
73
75
62

MODULAR INTERLOCKING RETAINING WALL/SEAWALL HAVING REDUCED INSTALLATION TIME

BACKGROUND OF THE INVENTION

1. Field of the Invention

This invention relates to seawalls. More particularly, it relates to a modular seawall construction that is relatively light-in-weight and easy to install in a relatively short amount of time as compared to conventional modular seawall constructions.

2. Description of the Prior Art

A seawall can be built as a monolithic unit, pouring concrete into a form that runs the extent of the property to be protected. This requires a concrete truck to deliver concrete to the site. This well-known method is labor intensive, time-consuming, and expensive.

Accordingly, inventors have developed modular seawalls that are manufactured off-site and delivered to the property to be protected. This eliminates the need to pour concrete at the site, is less labor intensive, reduces the cost of seawall construction, and provides consistently cured concrete to ensure maximum PSI.

A typical modular seawall is built of concrete modules, each of which is about four feet (4') in height and about six feet (6') in length. A common construction includes a ground-supported rectangular base, an upstanding rectangular sea-retaining wall that is positioned along one of the long edges of the base in perpendicular relation thereto, and an upstanding brace wall positioned along each of the short edges of the base at opposite ends of the sea-retaining wall. Each brace wall may also be rectangular in configuration. However, a brace wall in the configuration of a right triangle having a height equal to the height of the sea-retaining wall and a base equal to the depth of the rectangular base, i.e., equal in length to the length of a short side of the rectangular base, is functional and saves concrete. In either configuration, the area between the brace walls and behind the upstanding seawall is filled with earth or other suitable fill materials to maintain the sea-retaining wall in its upright configuration.

These well-known modular units are very heavy and require a truck-mounted crane at the assembly site.

A need exists, therefore, for a modular seawall that is light enough to be lifted by lighter and less expensive machinery than a truck-mounted crane.

Conventional seawall modules also lack an interlock means; they are merely positioned in end-to-end abutting relation to one another. This allows water and earth to gradually leak between abutting brace walls and weaken the structure.

Thus there is a need for a modular seawall construction that interlocks abutting seawall modules in end-to-end relation to one another and which prevents seepage of earth and water between contiguous modules.

A typical seawall installation includes a concrete sidewalk that overlies the horizontal top wall of the seawall. Pouring such a sidewalk is problematic because it is very difficult and time-consuming to attach an outermost vertical form for the concrete sidewalk to the water side of the seawall. It typically takes a crew of four workers to install that particular form. A level line must first be made on the module or modules a few inches below the top wall of the module or modules so that the workers can hold the horizontally disposed elongate form in a level plane while orienting the form in a vertical plane so that its bottom edge is in registration with the level line, thereby assuring that the top edge of the form will also be substantially level. Two workers are stationed on the water side, and sometimes in the water, at opposite ends of the horizontal, elongate form to hold the form in said vertical orientation in said level plane. Two other workers then attach the form to the seawall. More particularly, the lower few inches of the vertically oriented elongate form is secured to the seawall so that the upper few inches of the form extends above the top edge of the seawall by a distance that determines the thickness of the sidewalk.

Thus there is a need for a seawall module that facilitates the attachment of a concrete sidewalk form to a seawall. More particularly, there is a need for a seawall module that enables the attachment of a sidewalk form thereto by a single worker.

For a typical waterfront property having about sixty feet (60') of shoreline to protect, it takes about four (4) weeks to install a conventional modular seawall.

Thus there is a need for a modular seawall construction that substantially reduces the amount of time required to install the seawall.

However, in view of the art considered as a whole at the time the present invention was made, it was not obvious to those of ordinary skill in this art how the identified needs could be met.

SUMMARY OF INVENTION

The longstanding but heretofore unfulfilled need for an improved seawall module is now met by a new, useful, and nonobvious invention.

The novel module that forms a modular part of a seawall includes a base having a generally parallelepiped configuration but with sea-facing and ground-facing walls slightly inclined from vertical to facilitate their removal from a mold. The base has a solid concrete construction including a substantially horizontal sea-side top wall, a substantially horizontal ground-side top wall, a substantially horizontal bottom wall, and a pair of slightly inclined front (sea-side) and back (ground-side) walls. The end walls of the module are vertical so that two (2) contiguous modules may closely abut one another when positioned in end-to-end relation to one another.

An upstanding sea-retaining wall is formed integrally with the base and is perpendicularly disposed with respect thereto. The upstanding sea-retaining wall also has a generally parallelepiped, solid concrete construction including a front wall facing a body of water, a back wall facing land, a horizontal top wall interconnecting respective top edges of the front and back walls, and a pair of vertical end walls formed integrally with the vertical end walls of the base. The front and back walls of the upstanding sea-retaining wall are slightly inclined from vertical to facilitate their removal from a mold.

The upstanding sea-retaining wall has a longitudinal axis substantially parallel to a shoreline protected by the seawall. The longitudinal axis is set back a predetermined distance from the front wall of the base. The predetermined distance is less than half of a distance from the front wall of the base to the back wall of the base.

A vertically-extending groove having a depth of about six inches (6") is formed in each end wall of the novel module, extending from the top wall of the upstanding sea-retaining wall to the bottom wall of the base. A flat, vertically extending tongue having a width of about twelve inches (12") is adapted to slidingly fit within laterally-adjacent vertically-extending grooves of contiguous seawall modules to interlock said contiguous modules to one another and to prevent water and earth seepage between them.

A recess of predetermined depth and height that forms a ledge is formed in the front, sea-facing wall of the upstanding sea-retaining wall and has a length equal to a length of the module. The recess is in open communication with the top wall of the upstanding sea-retaining wall and forms a horizontal support ledge a predetermined distance below the top wall. The recess is adapted to accommodate and support an elongate strip of material such as plywood that is positioned on edge within the recess atop the ledge. The elongate strip of material is a form for a concrete sidewalk and has a length and depth substantially equal to the length and depth of the recess. The height of the elongate strip of material is greater than the height of the recess so that the form extends above the top wall of the module by a distance equal to the thickness of a sidewalk to be built contiguous to the seawall.

Two sets of concrete reinforcing bars, known as rebars, are embedded in the module. The rebars in each set are disposed in equidistantly and longitudinally spaced relation to one another along the longitudinal extent of each module.

Each rebar of a first set of rebars has a horizontal lowermost end embedded in the concrete base on the ground-side of the base and a gradual approximately ninety degree (90°) bend formed therein so that a vertical part thereof is embedded in the concrete of the upstanding seawall. The uppermost end of each rebar of this first set extends above the top wall of the seawall in a vertical plane by about thirty inches (30"). A gradual ninety degree (90°) bend towards the ground-side is then formed in said uppermost end of each rebar so that each uppermost end is disposed in a substantially horizontal plane so that it can be used to provide reinforcement for the concrete sidewalk to be built adjacent the seawall.

Each rebar of a second set of rebars has a lowermost end embedded in the concrete base for a short distance on the sea-side of the base and a gradual approximately ninety degree (90°) bend is formed therein so that a vertical part thereof is embedded in the concrete of the upstanding seawall. The uppermost end of each rebar of this second set of rebars is substantially flush with the top wall of the seawall. Each rebar of the second set is cooperatively aligned with a corresponding rebar of the first set.

A mold for making a module forming part of a modular seawall includes a base mold having a generally parallelepiped configuration and a sea-retaining wall mold, also having a generally parallelepiped configuration, secured to the base mold in upstanding relation thereto. When filled with a cementitious material, the mold produces an upstanding solid sea wall formed integrally with a solid base.

The base mold includes a bottom wall, a front wall slightly inclined from vertical, a back wall slightly inclined from vertical, a horizontal front base top wall welded along its front edge to said front wall, and a horizontal back base top wall welded along its back edge to the back wall. The front and back walls are mounted to the front and back edges, respectively, of the bottom wall.

The sea-retaining wall mold includes a sea-facing front wall slightly inclined from vertical, a ground-facing back wall slightly inclined from vertical, and an open top. The lower edge of the front wall is welded to the back edge of the horizontal front base top wall of the base mold and the lower edge of the back wall is welded to the front edge of the horizontal back base top wall of said base mold.

The respective open ends of the base mold and the sea-retaining wall mold are closed by bulkheads. Each bulkhead has a flat main body that has the general form of an inverted "T" when viewed in end elevational view. More particularly, the vertical extent of each bulkhead main body closes the space between the front and back walls of the upstanding seawall mold and the horizontal extent of each bulkhead main body closes the space between the front and back walls of the base mold.

A pair of flat projections is formed integrally with the main body of each bulkhead. A first flat projection has a length of about six inches (6") and extends perpendicularly from a first, inboard side of its bulkhead along the entire extent thereof, i.e., from the top to the bottom of said bulkhead. A second flat projection also has a length of about six inches (6") and extends perpendicularly from a second, outboard side of its bulkhead along the entire extent thereof, i.e., from the top to the bottom of said bulkhead.

One bulkhead thus provides an end wall for two contiguous seawall molds. When concrete is poured into two contiguous molds at the same time, the first flat projection produces a six inch (6") deep groove from the top to the bottom of an end wall of a first seawall module and the second flat projection produces a six inch (6") deep groove from the top to the bottom of an end wall of a second seawall module. A flat tongue is introduced into contiguous grooves at the installation site to interlock contiguous modules to one another.

In a first embodiment, the mold is preferably formed of steel. This enables a large number of modules to be manufactured in a relatively short period of time.

In a second embodiment, the mold is formed of aluminum, wood, or other material that requires bracing. The top wall of the base on the sea side of the module, referred to above as the sea-side or front base top wall, is hingedly mounted to a top edge of the front wall of the base mold and extends from the front wall of the base mold to the lower edge of the front wall of the sea-retaining wall mold. The sea-side base top wall has a length substantially equal to a length of the base mold.

The top wall of the base on the ground side of the module, referred to above as the ground-side or back base top wall, is hingedly mounted to a top edge of the rear wall of the base mold and extends from the rear wall of the base mold to the lower edge rear wall of the sea-retaining wall mold. The ground-side base top wall has a length substantially equal to a length of the base mold.

In the second embodiment, at least one stiffener rod or dowel prevents opening of the first and second cover walls when the base mold is filled with concrete. At least one dowel housing is formed in a top surface of the front base top wall and at least one dowel housing is formed in a top surface of the back base top wall. The dowel housings of the front and back base top walls are in longitudinal alignment with one another. A stiffener rod or dowel is slideably received within each of the dowel housings to prevent the front and back base top walls from rotating about their respective hinges when the base mold is filled with cementitious material.

A cementitious material is poured into the mold through the open top of the sea-retaining wall mold until the base mold is full and the cementitious material is substantially level with said open top.

In both embodiments, the slightly inclined front and back walls of the base mold are braced with steel braces, each of which is one half inch (½") thick. Each steel brace of a first plurality of steel braces has a first part welded in abutting relation to the front wall of the base mold and a second part adapted to be secured to a support surface such as a floor or concrete pad. Each steel brace of a second plurality of steel braces has a first part welded in abutting relation to the back wall of the base mold and a second part adapted to be secured to said support surface.

A concrete-displacement member having a predetermined height, a predetermined depth, and a length equal to a length of the mold is attached to a back surface of the front wall of the upstanding sea-retaining wall mold. The concrete-displacement member has a top edge flush with the open top of the upstanding sea-retaining wall mold. The concrete-displacement member is removed from the mold after concrete poured into the mold has cured. The removed concrete-displacement member forms a recess in the sea-side of the sea wall that is adapted to accommodate and support an elongate strip of material that is positioned on edge within the recess. The elongate strip of material has a depth and length substantially equal to a depth and length of the concrete-displacement member and of the recess. The height of the elongate strip of material exceeds the height of the recess by a distance equal to the thickness of a sidewalk to be poured after installation of the sea wall.

An important object of the invention is to provide a seawall formed of modules where each module is lighter-in-weight than conventional seawall modules, free of brace walls, and easily interlockable with contiguous modules.

Another important object is to provide such modules so that the length of time required to install a seawall can be substantially reduced.

Another object is to eliminate the need for a concrete truck or a truck-mounted crane at the site of a seawall installation.

Still another object is to reduce the number of workers required to install a seawall.

Yet another object is to provide a seawall construction that facilitates the pouring of a sidewalk contiguous with the seawall after the seawall has been installed.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1A:
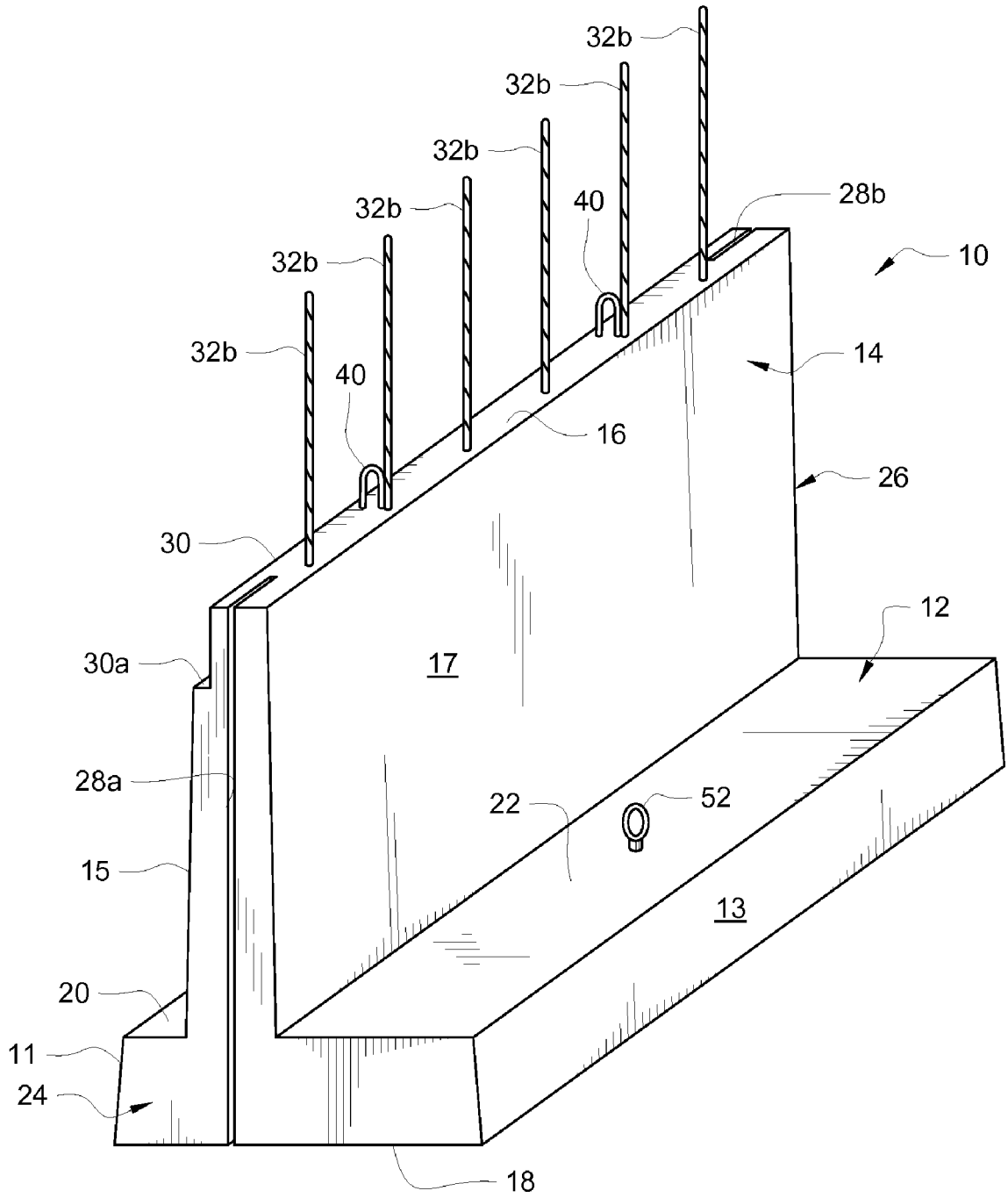
FIG. 1A is a perspective view of a novel interior seawall module.

Referring now to FIG. 1A, it will there be seen that an illustrative embodiment of the invention is denoted as a whole by the reference numeral 10. Novel interior seawall module 10 will be sold commercially under the trademarks Solid Operating Seawall™ and SOS™.

Novel interior seawall module 10 has horizontal base 12 of generally parallelepiped configuration including front base wall 11 and back base wall 13 and upstanding sea-retaining wall 14, also of generally parallelepiped construction, including front wall 15 and back wall 17, said sea-retaining wall 14 being disposed perpendicular to said base and formed integrally therewith.

More particularly, interior module 10 further includes top wall 16, bottom wall 18, sea-side base top wall 20, ground-side base top wall 22, first end wall 24, and second end wall 26. However, unlike conventional modular seawalls, sea-retaining wall 14 is not positioned along a sea-facing edge of base 12 but is set back therefrom as depicted. Moreover, novel modular unit 10 has no brace walls. Such absence of brace walls reduces the amount of concrete required to make the unit and thus reduces its weight so that it can be delivered to a job site in the absence of a truck-mounted crane. A small backhoe may be used instead.

Although the dimensions are not critical, novel module 10 is preferably six feet (6') in length, five feet (5') in overall height (base 12 being one foot (1') in height and vertical sea-retaining wall 14 being four feet (4') in height), and about thirty-nine inches (39") in depth or width. For a typical sixty foot (60') seawall, ten (10) of such interior modules would be required if the wall were tied into an adjoining, pre-existing seawall.

Figure 1B:
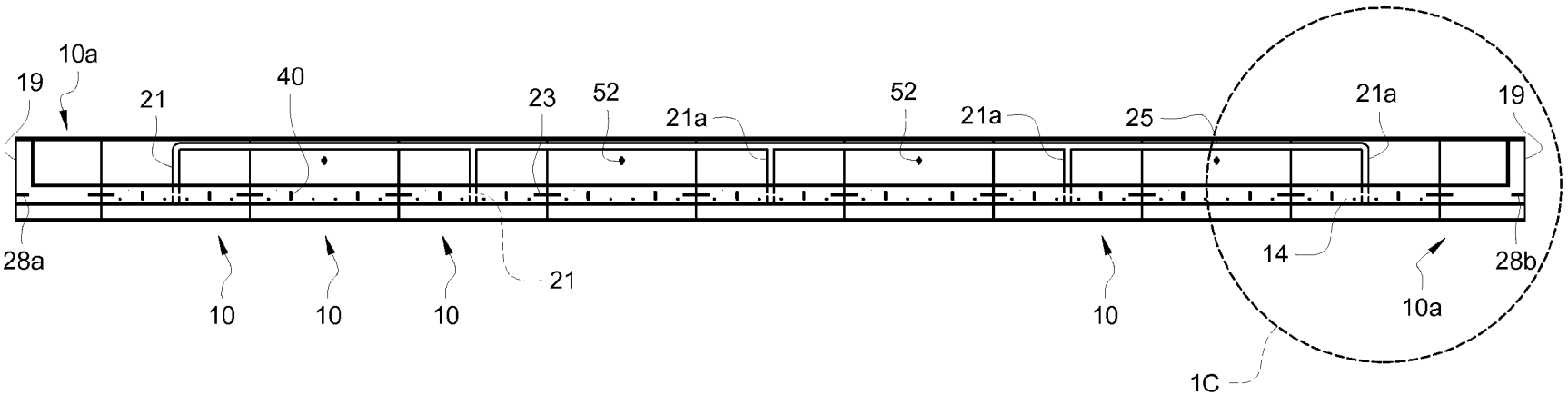
FIG. 1B is a top plan view of a novel seawall including nine (9) interior and two (2) end modules and a drainage pipe assembly.

However, in many installations there will be no adjoining wall into which the novel modules may be connected. Accordingly, in a typical 60 foot (60') installation, as depicted in FIG. 1B, only nine (9) interior modules are used, thereby covering fifty four feet (54'), and two (2) end modules 10*a*, each of which is three feet (3') in length, are positioned at opposite ends of the installation. Each end module 10*a*, also depicted in FIG. 1C, has an end wall 19 that is disposed at a ninety degree (90°) angle relative to sea-retaining wall 14. As a practical matter, end modules 10*a* are placed into position first at an installation site, and the interior modules 10 are positioned between said end walls.

Figure 1C:
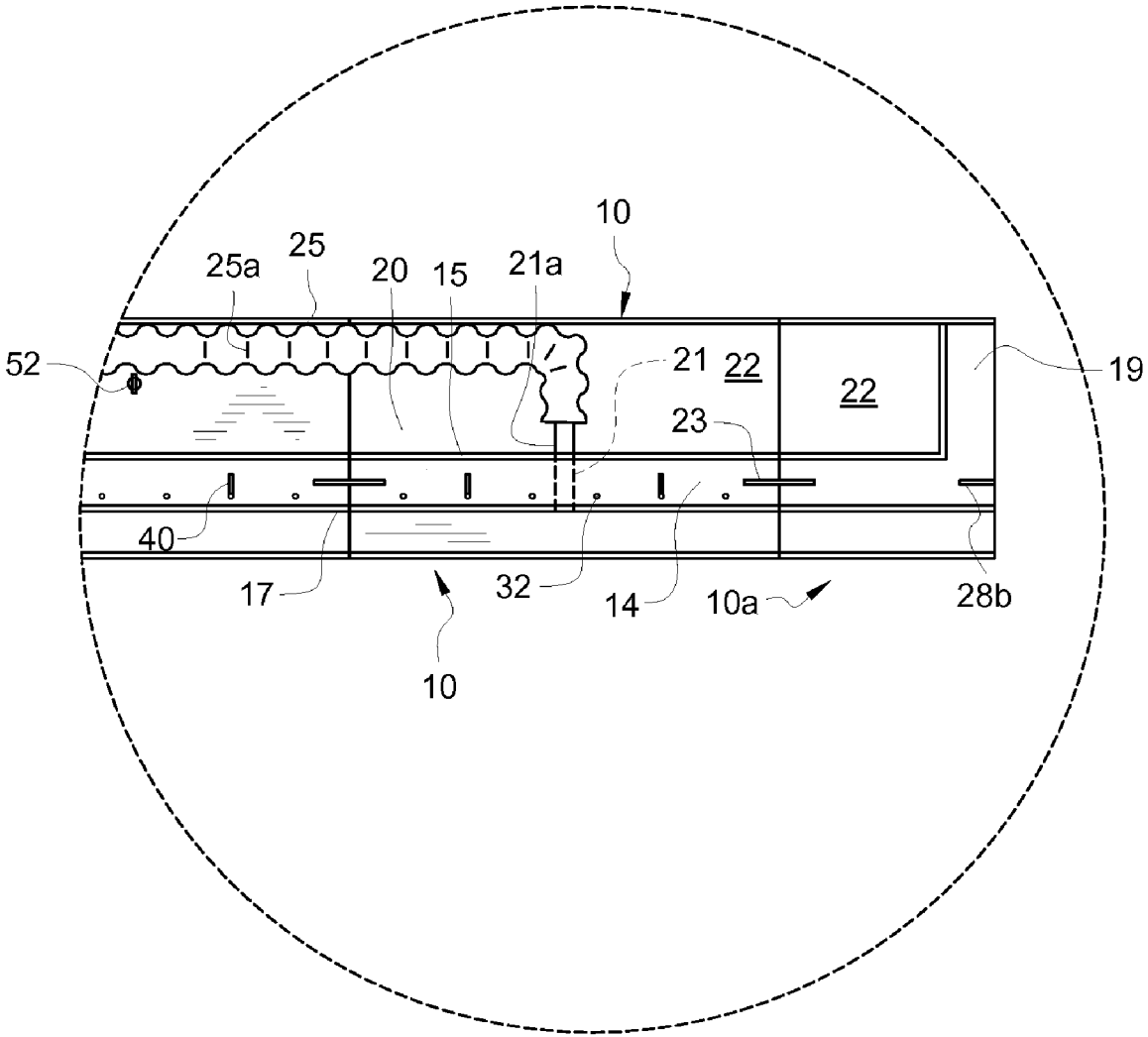
FIG. 1C is an enlarged view of the part circled in FIG. 1B and labeled 1C.
Figure 1D:
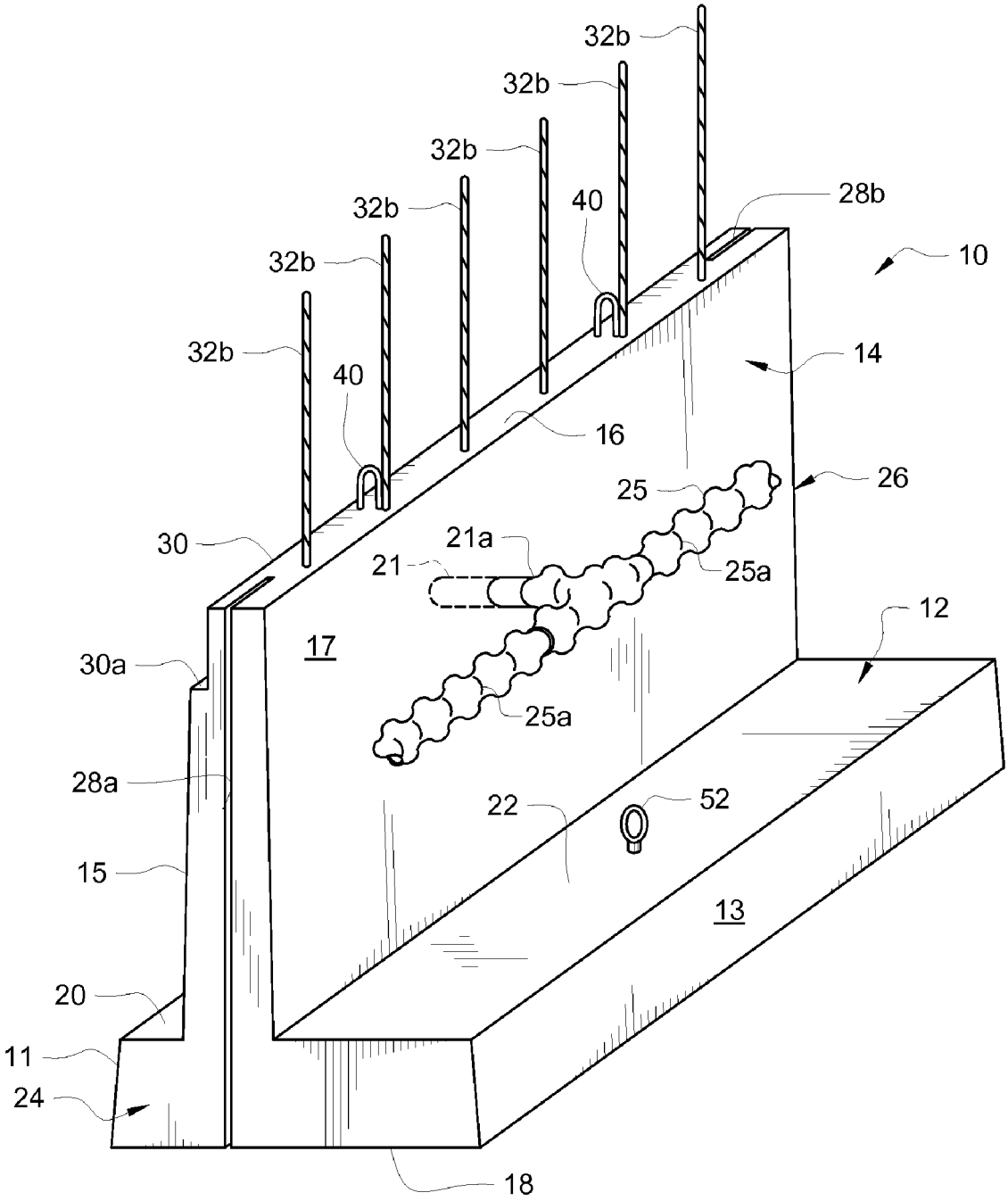
FIG. 1D is a perspective view of an interior module including a partial view of the drainage pipe assembly.

As depicted in FIGS. 1B-D, a four inch (4") in diameter PVC pipe or insert 21 is positioned in some but not all of the modules at a location about twenty four inches (24") below top wall 16. Each insert is horizontally disposed. For a sixty foot (60') installation formed by nine (9) of the novel interior modules 10 and two end modules 10*a*, there could be a total of four (4) inserts 21 at equidistantly spaced intervals, for example. Specifically, a first insert would be eighteen inches (18") from a first end of an end module 10*a*, a second insert would be spaced nineteen feet (19') from the first insert or twenty and one-half feet (20.5°) from the first end of the seawall, a third insert would be spaced nineteen feet (19') from the second insert or thirty nine and one-half feet (39.5°) from said first end, and a fourth insert would be spaced nineteen feet from the third insert or fifty eight and one half feet (58.5°) from the first end which is eighteen inches (18") from the end of a second end module 10*a*. Thus, a drainage insert 21 would be present in only four (4) of the eleven (11) modules in such an installation. Depending upon the type of soil, the number of drainage inserts could be increased or decreased and the spacing between them varied accordingly. The installation of FIG. 1B has an increased number of inserts 21 relative to the example just provided. Each insert 21 is in fluid communication with a "T"-connection 21*a* that is in fluid communication with an elongate drainage pipe 25 covered by soil on the land-side of the seawall.

Elongate drainage pipe 25 is corrugated as shown. It is flexible and is bent at a gradual ninety degree (90°) bend at each end module 10*a*. A plurality of slits 25*a* are formed in said pipe along its extent to provide the drainage. A tubular sock, not illustrated, covers each pipe section between "T"-connections 21*a* to keep dirt from blocking the slits. The sock is permeable to water and does not interfere with drainage. Although other drainage systems may be used, such as the French system, the illustrated drainage pipe manufactured by Advanced Drain Systems is preferred.

Grooves 28*a* and 28*b* are formed in end walls 24 and 26, respectively, of each interior module 10. Each groove has a depth of about six inches (6") and extends the entire height of module 10, said groove being centered with respect to vertical wall 14. The width of each groove is about one-half inch (½"). Such grooves are also provided in the outboard wall of end modules 10*a* as well in the event that the adjacent seawall is also provided with such novel grooves.

Figure 3A:
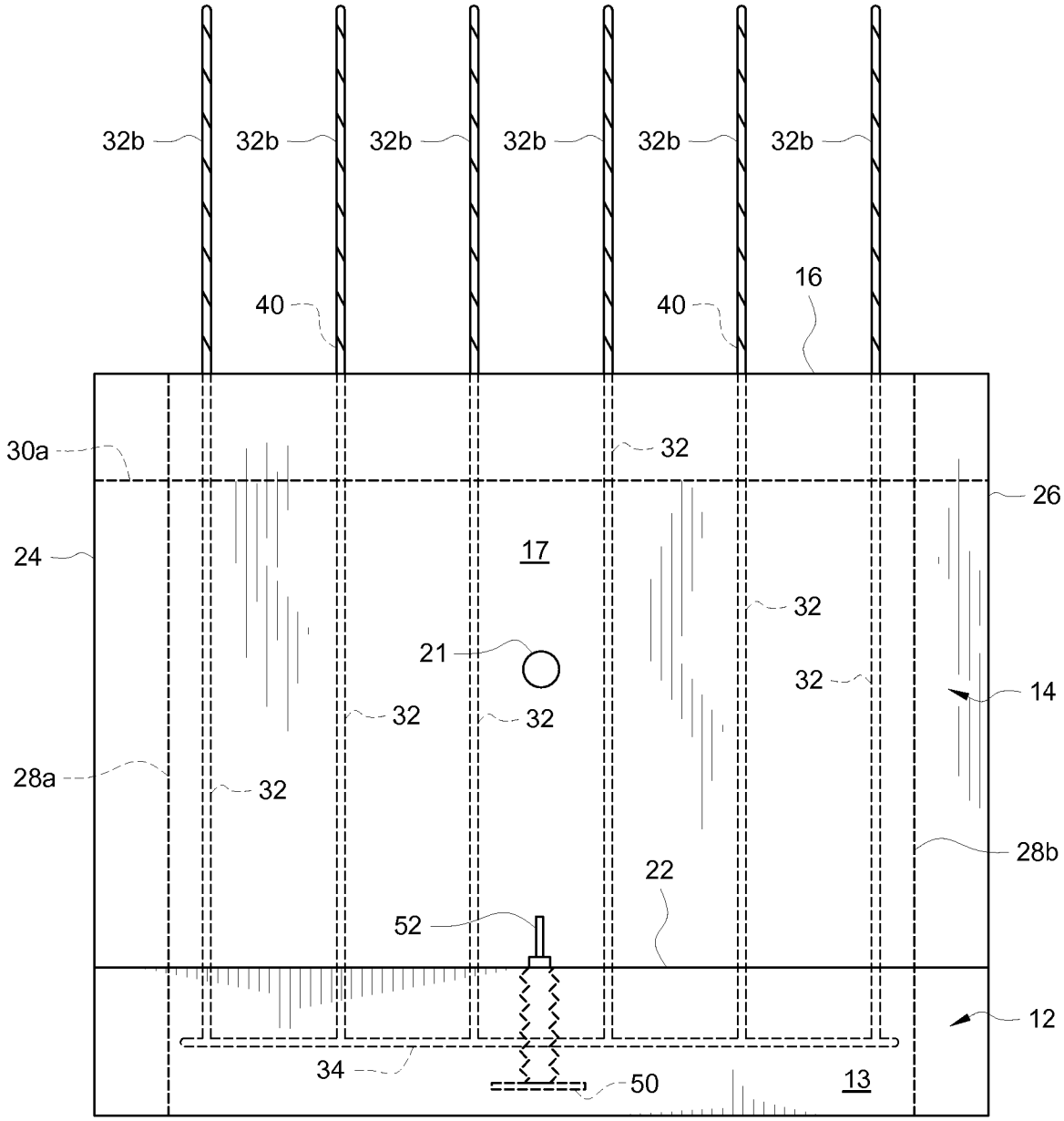
FIG. 3A is a front elevational view of a completed seawall interior module.
Figure 3B:
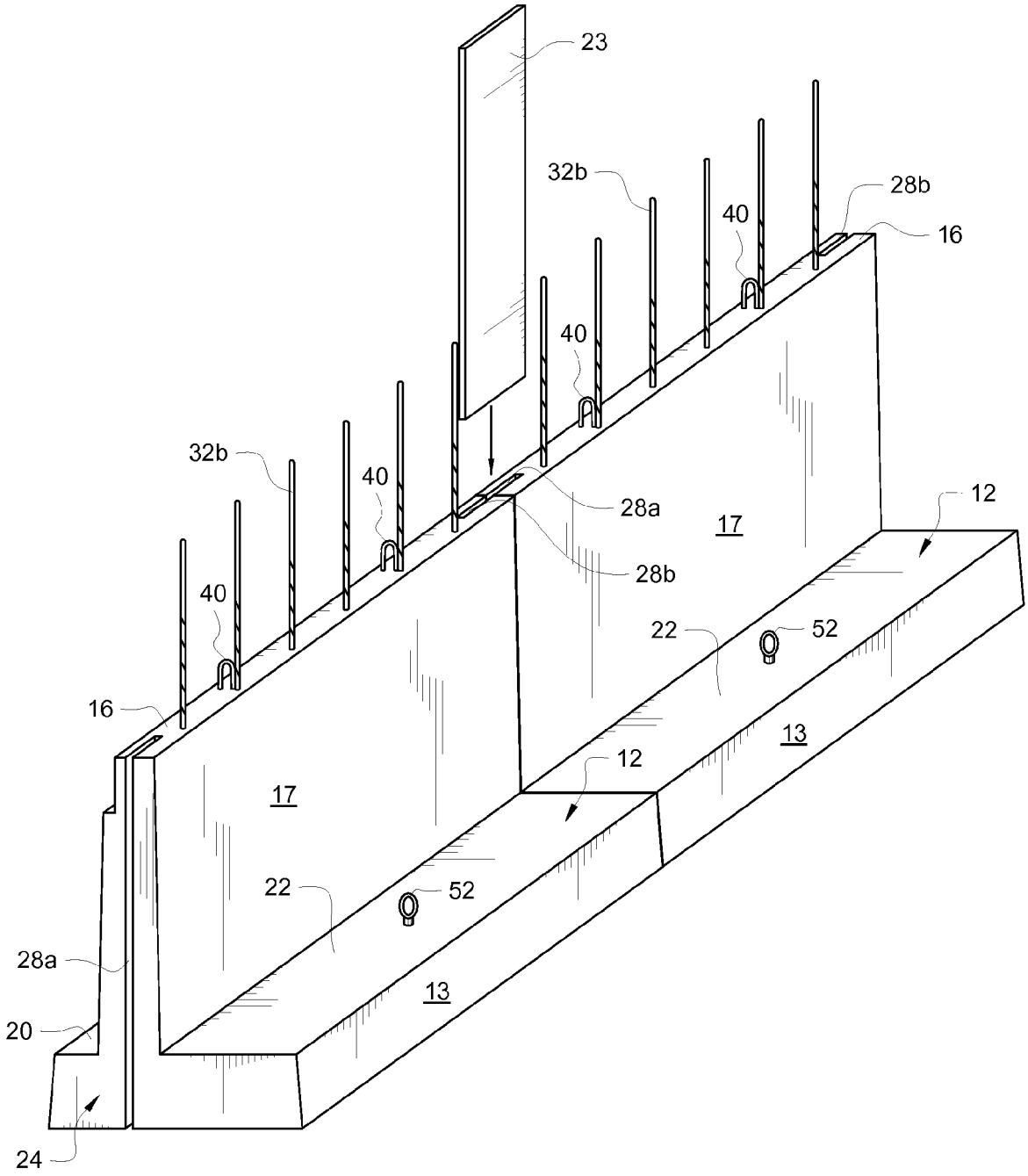
FIG. 3B is a perspective view depicting two interior modules in side-by-side relation to one another and including a view of a flat plate used in interlocking contiguous interior modules to one another.
Figure 4:
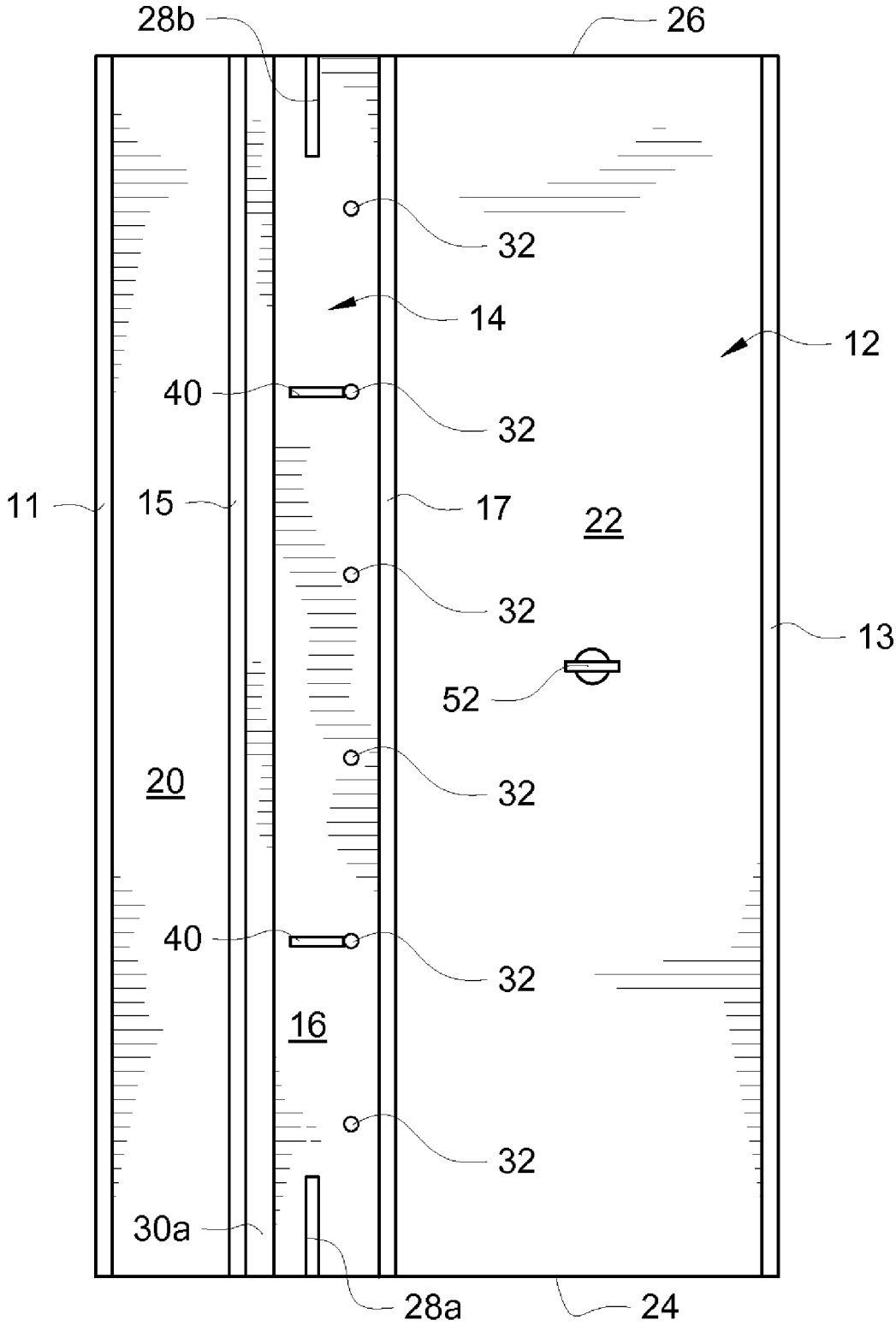
FIG. 4 is a top plan view of a single interior module.

A seawall is built by positioning a plurality of modules 10 in end-to-end relation to one another, i.e., with respective end walls of contiguous modules abutting one another as depicted in FIG. 3B. At the installation site, a flat tongue, denoted 23 in FIG. 3B, having a width slightly less than twelve inches (12"), a thickness of slightly less than one-half of an inch (½") and a height of about five feet (5') is slid into each pair of confronting grooves from the top of the grooves to interlock contiguous modules to one another, and to prevent seepage of water and earth between them. Again, as aforesaid, no end modules 10*a* are needed if the seawall can be tied into pre-existing sea walls at each end.

Recess 30 is formed in the water-facing front wall 15 of sea-retaining wall 14 and is in open communication with top wall 16 of modules 10 and 10*a*. It forms ledge 30*a* that supports an elongate strip of material such as plywood that is positioned in a vertical orientation on its edge atop ledge 30*a*. The top edge of the plywood extends above top wall 16 by a distance that determines the thickness of a concrete sidewalk that is poured after installation of the novel modules.

Figure 2A:
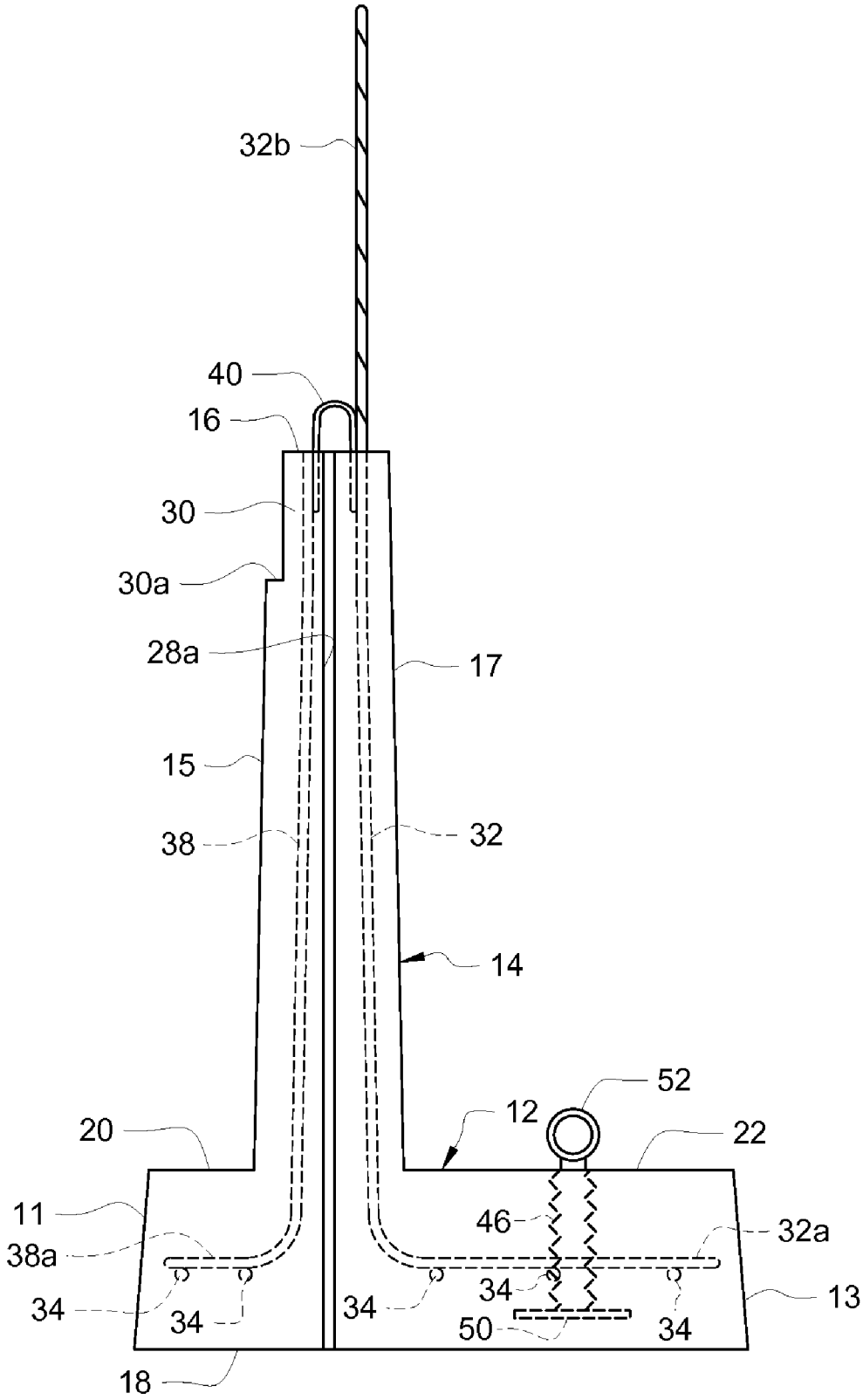
FIG. 2A is an end elevational view of an interior seawall module.

A first plurality of rebars, collectively denoted 32, is embedded within each interior module 10 (and also each end module 10*a*) and each rebar extends above top wall 16 by about thirty inches (30"). Each rebar 32 has a gradual ninety degree (90°) bend formed therein near its lower end, as depicted in FIGS. 2A and 2B, to form lower horizontal section 32*a* that is embedded in the ground-facing side of base 12 and held in position by horizontal rebars, collectively denoted 34, that extend lengthwise through module 10.

Figure 2B:
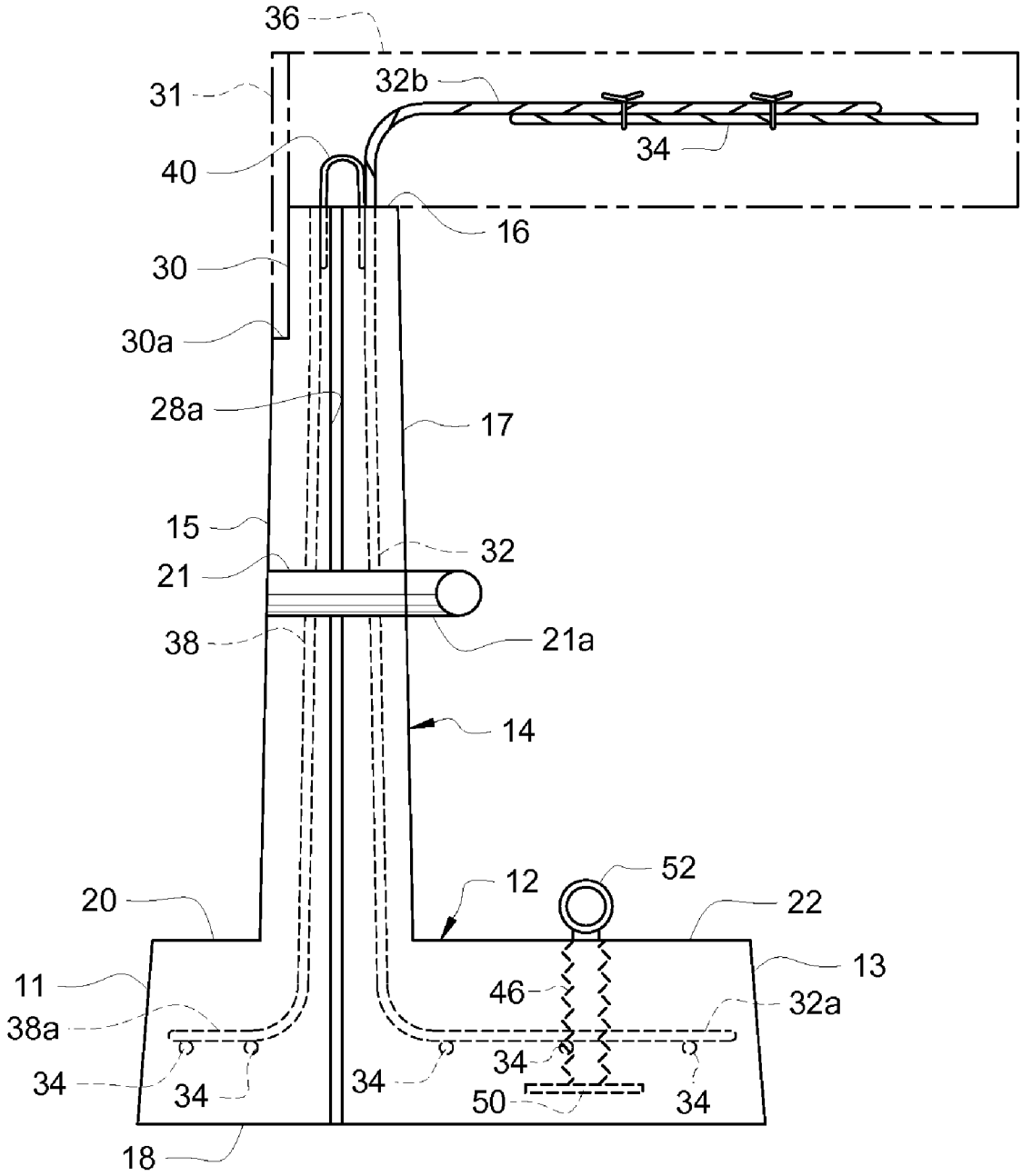
FIG. 2B is an end elevational view depicting rebars bent towards the ground-side of the installation.

As depicted in FIG. 2B, each rebar 32 is also bent at a gradual ninety degree (90°) angle a few inches above top wall 16 so that it extends towards the ground-facing side of module 10 in a substantially horizontal plane. The horizontal extent 32*b* of each rebar 32 at its upper end will therefore be about twenty four inches (24"). Additional horizontal rebars, denoted 34, are lashed to rebars 32 so that the combined horizontal extent of such rebars is about forty eight inches (48"). Note that the distal end of rebar 34 does not extend to the surface of the concrete but is embedded at least one one-half inches (1.5") from said surface. Such rebars are then ready to be embedded in a concrete sidewalk, indicated in dotted lines as at 36, having a width of about forty eight inches (48") and a thickness of at least five inches (5"), where the sea-side edge of such sidewalk is flush with sea-facing wall 15 of vertical wall 14. Upper and lower ends 32*a*, 32*b* of each rebar 32, as well as each additional rebar 34, are positioned perpendicular to the shoreline, i.e., perpendicular to a longitudinal axis of symmetry of module 10.

A second plurality of rebars, collectively denoted 38, have a short horizontal extent 38*a* embedded in the sea-facing side of base 12 and a vertical extent that terminates substantially flush with top wall 16. The rebars of the second set of rebars are also equidistantly and longitudinally spaced apart from one another. They, like the first set of rebars 32, are supported by longitudinally-extending rebars 34.

The plywood form that fits atop ledge 30*a* of recess 30 is denoted 31 in FIG. 2B.

Rebars 32 are depicted in their respective unbent configuration in FIGS. 1, 2A, 3A, 3B, and 4.

Two (2) relatively short rebars, collectively denoted 40, are bent into a "U" shape to provide attachment members that enable module 10 to be lifted by a lifting device such as a backhoe. As depicted in FIG. 2A, a first short "U"-shaped rebar 40 is inverted, a first end is welded to a selected sea-side rebar 38 and a second end is welded to a selected ground-side rebar 32 that is associated with the selected sea-side rebar. A second short "U"-shaped rebar 40 is then welded at its opposite ends between a selected sea-side rebar 38 and its associated ground-side rebar 32. The bight of each short rebar is positioned above the plane of top wall 16 so that the opposite ends of each rebar are embedded within the concrete after said concrete has cured. This enables a lifting device to engage the bight of each short rebar.

It may also be desired to position another attachment member to base 22 of module 10. As best understood in connection with FIG. 2C, the mold is lifted from the support surface and internally threaded anchor sleeve 48 having flange 50 formed in its trailing end is manually positioned in the hollow interior of base 22, substantially centrally thereof, prior to pouring of concrete into the mold. Externally threaded plug 42 having tool-engageable head 44 is screwthreadedly engaged to said anchor sleeve prior to the pouring of the concrete and both anchor sleeve 48 and plug 42 are left in place as the concrete is poured. After the concrete has cured, plug 42 is then rotated by engaging head 44 with a tool, not depicted, so that said plug is unscrewed from anchor sleeve 48. Flange 50 cooperates with the screw threads to prevent anchor sleeve 48 from disengaging from the cured concrete. Eyehook 52 or other suitable attachment member is then screwthreadedly engaged to anchor sleeve 48.

Figure 2C:
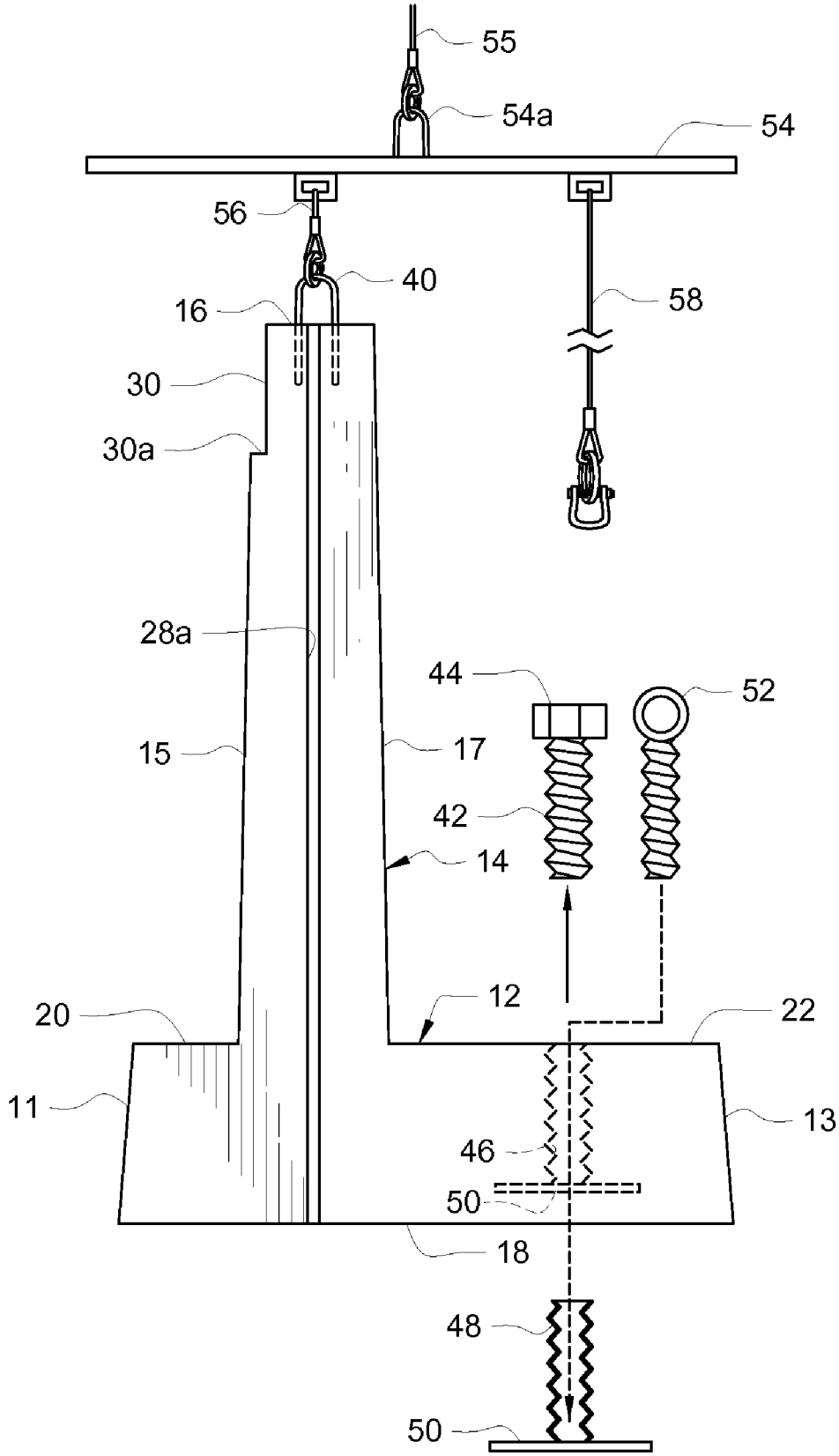
FIG. 2C is an end elevational view depicting a lifting device for lifting a completed seawall interior module.

The lifting device, depicted in FIG. 2C, may take the form of a horizontal plate 54 having three parallel cables depending therefrom. Two of the cables 56 have the same length and engage the respective bights of short rebars 40. A third cable 58 has a greater length than said two cables 56 and has a length sufficient to enable it to engage eyehook 52 that engages anchor sleeve 48. A suitable lifting device such as a backhoe then lifts horizontal plate 54 though cable 55. The weight of module 10 is quite evenly distributed among the three cables during the lifting process. The third lifting point also helps the module maintain its balance during lifting.

Having seen novel module 10, those of ordinary skill in the art can make and use said module without further disclosure.

However, there are two (2) slightly different ways of making a suitable mold, so both of said ways will be disclosed.

Figure 5:
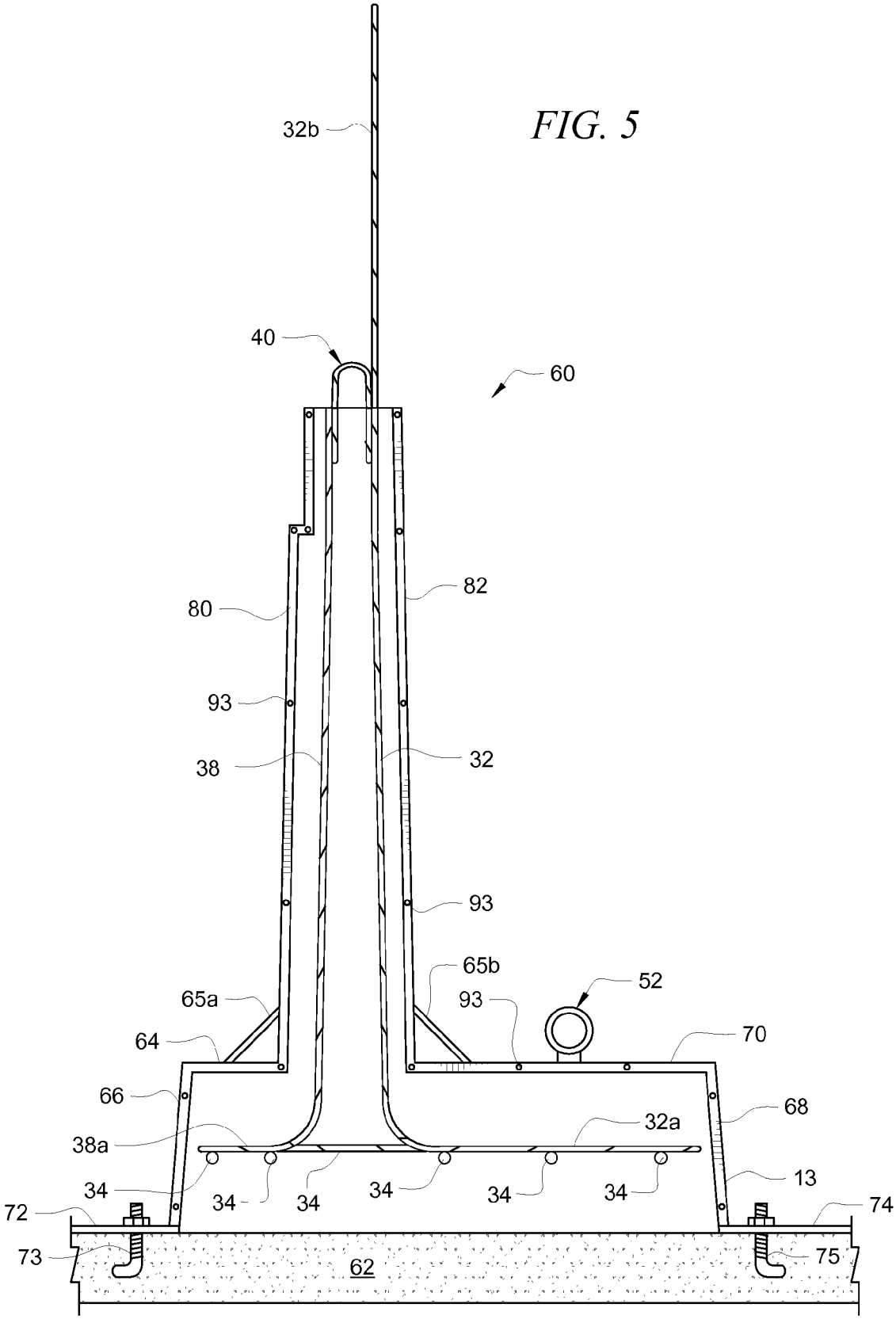
FIG. 5 is an end elevational view of a first embodiment of the novel mold.

A first embodiment of mold 60 is depicted in FIG. 5. Mold 60 is supported by concrete pad 62, said pad being the floor of a manufacturing facility. Front wall 66 is mounted to the front edge of bottom wall 64 and is slightly inclined from vertical as depicted. Back wall 68 is mounted to the back edge of bottom wall 70 and is also slightly inclined from vertical as depicted. Front wall steel brace 72 is bolted to concrete pad 62 by J-bolts 73. Back wall steel brace 74 is bolted to concrete pad 62 by J-bolts 75.

Sea-side base top wall 64 is welded to the top edge of front wall 66. Base top wall 82 has a length equal to the length of the mold. Ground-side base top wall 70 and is welded to the top edge of back wall 68. Base top wall 84 also has a length equal to the length of the module. Base top walls 64 and 70 are steel plates that are one-half of an inch (½") thick.

FIG. 5 also indicates that a first plurality of triangular-in-configuration gusset braces, collectively denoted 65*a*, are used to brace sea-side base top wall 64 and sea-side mold wall 80, and that a second plurality of triangular-in-configuration gusset braces, collectively denoted 65*b*, are used to brace ground-side base top wall 70 and ground-side mold wall 82. Gusset braces 65*a* preferably extend along the extent of each mold on the sea-side thereof in equidistantly and longitudinally spaced apart relation to one another, preferably at about one foot (1') spacings. Gusset braces 65*b* preferably extend along the extent of each mold on the ground-side thereof in the same equidistantly and longitudinally spaced apart relation to one another. These gusset braces 65*a*, 65*b* are preferably much larger than depicted. In a preferred embodiment, their vertical extent is as high as mold walls 80, 82 and their horizontal extent is equal to that of said base top walls 64, 70, respectively.

Generally upstanding sea-side mold wall 80 is also formed of one-half an inch (½") thick steel plate and has a length equal to the length of the module. It is mounted along the inboard extent of first, sea-side base wall 64. Generally upstanding ground-side mold wall 82 is formed of one-half inch (½") thick steel plate as well and is mounted along the inboard extent of second, ground-side base wall 70. Generally upstanding mold walls 80 and 82 are preferably forty eight inches (48") in height.

The opens ends of the mold are closed by a steel bulkhead. As depicted in FIGS. 6A, 6B, 7, and 8, steel bulkhead 90 has a generally inverted "T"-shape and closes a first open end of the novel mold. A second steel bulkhead having the same structure closes a second open end of the novel mold. The bulkheads segregate the individual solid operating seawall modules from one another as they are poured. Each bulkhead 90 is made of steel plate about one-half inch (½") thick. The base of the bulkhead has a depth about four inches (4") greater than base 12 of module 10 because the steel walls of mold 60 are each two inches (2") thick as aforesaid.

Figure 6A:
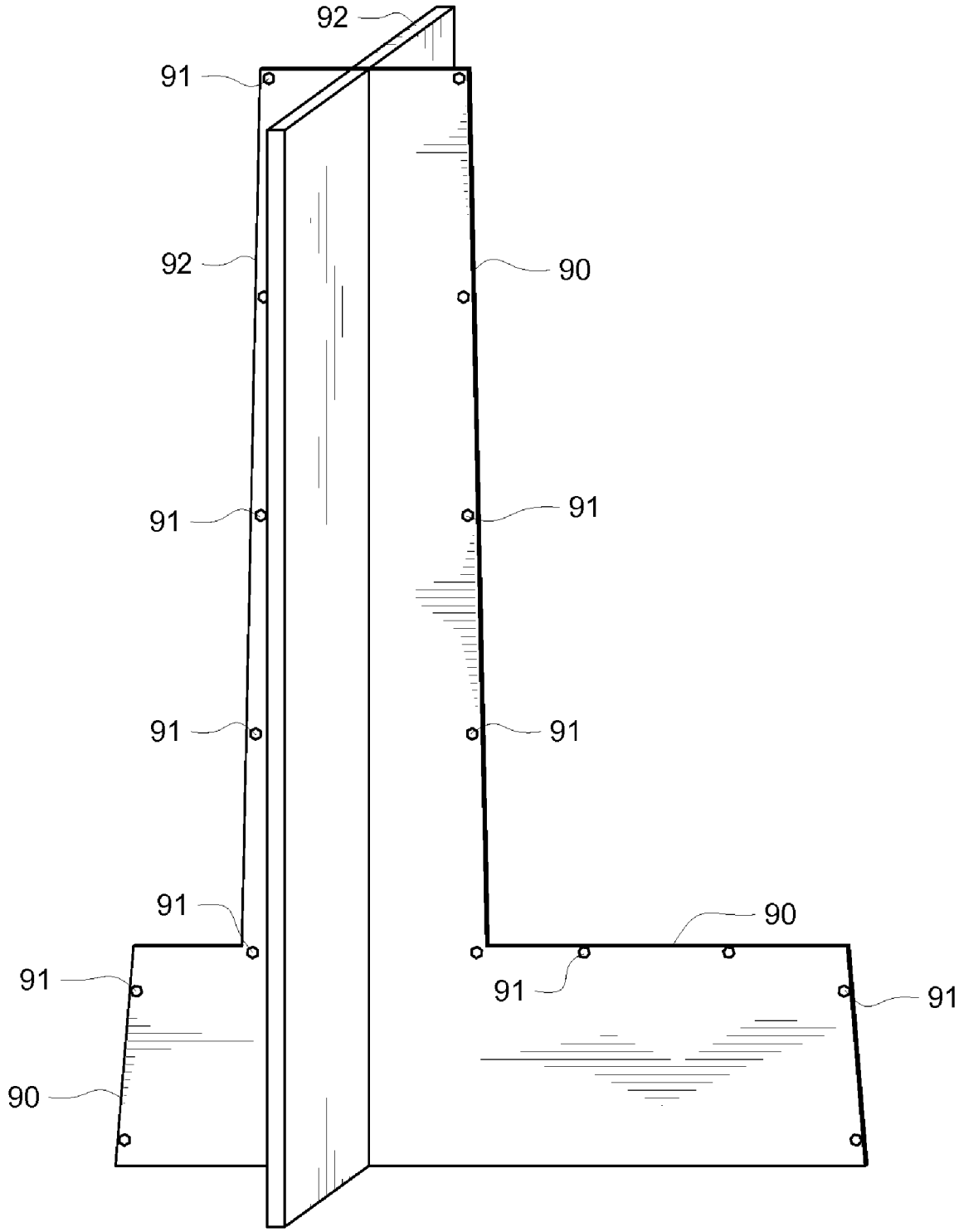
FIG. 6A is a perspective view of a bulkhead.
Figure 6B:
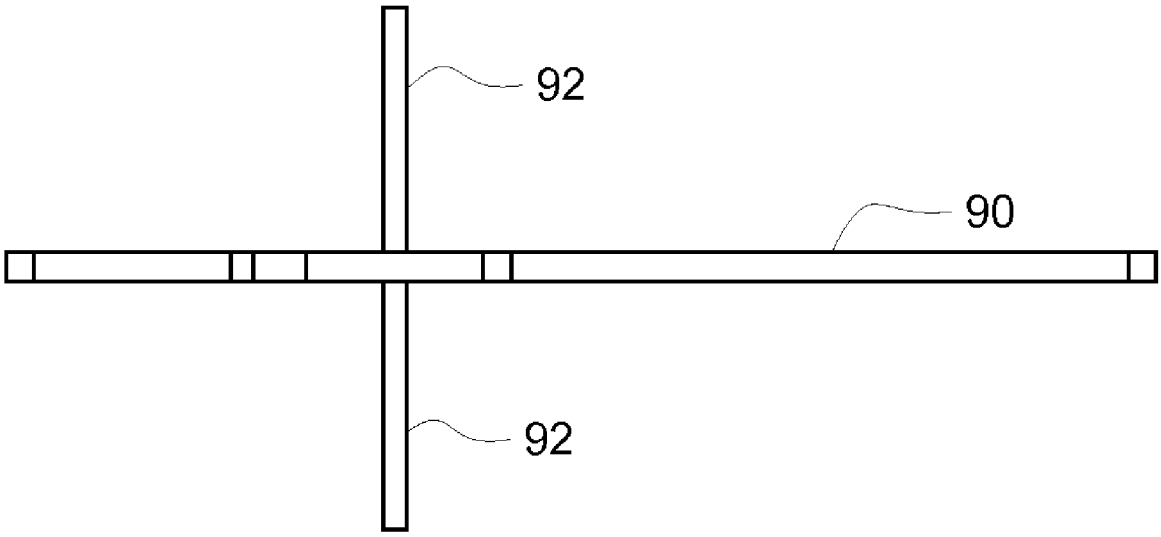
FIG. 6B is a top plan view of the bulkhead depicted in FIG. 6A.

FIG. 6B depicts bulkhead 90 in plan view. Tongues 92 are perpendicular to the flat part of bulkhead 90 and said tongues are embedded in the poured concrete. When tongues 92 are removed after the concrete has cured, vertical grooves 28*a*, 28*b* having a depth equal to the extent of the tongues extends along each end wall 24, 26 of concrete module 10.

Openings 91 formed in each bulkhead 90 enable said bulkhead to be bolted to the end of each mold 60. More particularly, openings 93 in FIG. 5 are aligned with openings 91 when said bulkheads 90 are attached to the opposite ends of mold 60.

Figure 7:
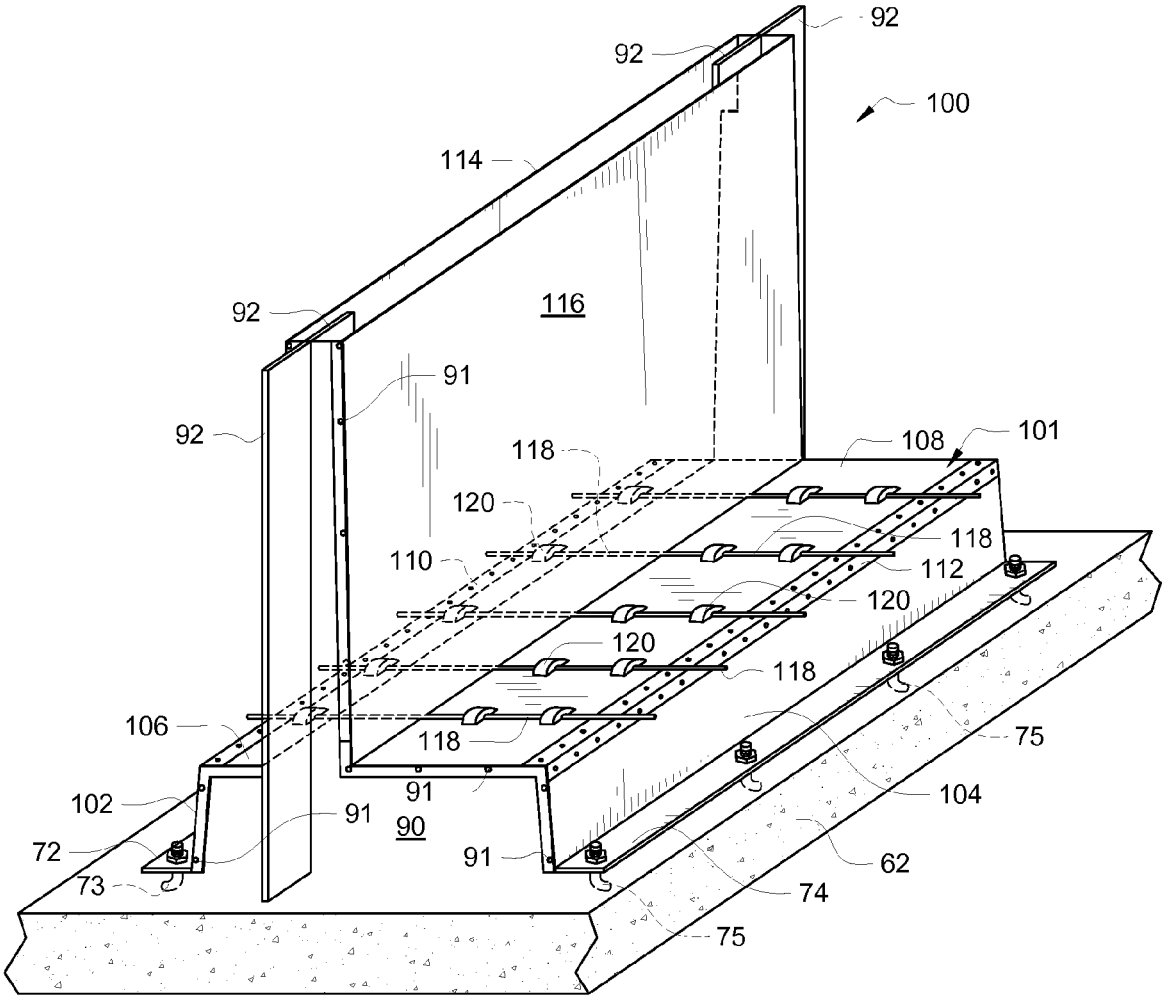
FIG. 7 is a perspective view of a second embodiment of the novel mold when the base top walls are closed.
Figure 8:
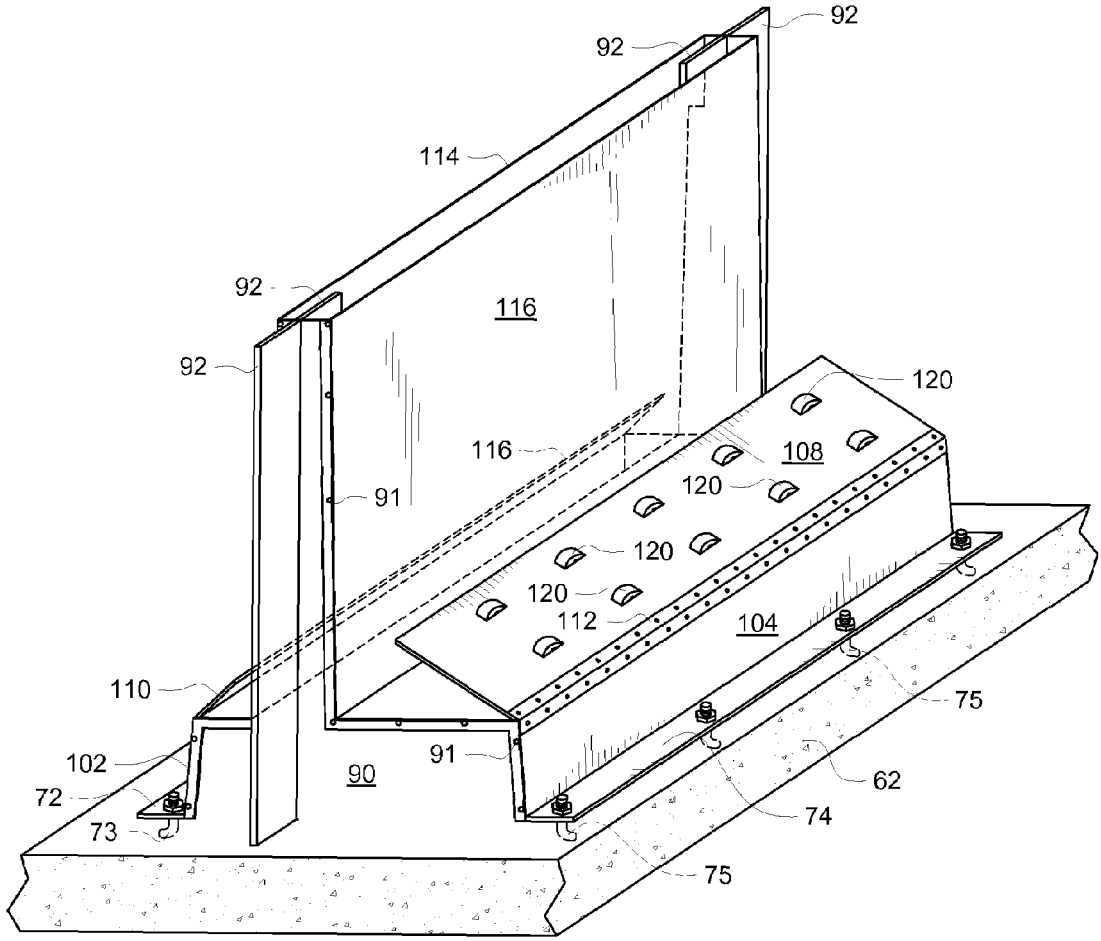
FIG. 8 is a perspective view of the second embodiment of the novel mold when the base top walls are open.

A second embodiment of the novel mold for making the novel seawall is depicted in FIGS. 7-8 and is denoted as a whole by the reference numeral 100.

Mold 100, like the first mold embodiment, is supported by concrete pad 62, said pad being the floor of a manufacturing facility. Neither mold has a bottom wall because each mold must be lifted from the module at the completion of the curing process. Front and back walls 102, 104 are slightly inclined from vertical and are welded to the front and back edges, respectively, of sea-side base top wall 106 and 108, respectively. The incline is one inch (1") in width or depth per twelve inches (12") in height. As in the first embodiment, steel braces, not depicted, are bolted to concrete pad 62 at their respective horizontal parts, preferably by J-bolts, also not depicted.

Sea-side base top wall 106 is mounted by piano hinge 110 to the top edge of front wall 102. Ground-side base top wall 108 is mounted by piano hinge 112 to the top edge of back wall 104. Base top walls 106, 108 are steel plates that are one-half inch (½") thick. The piano hinges are provided so that said base top walls may be pivoted out of the way when the completed seawall module is removed from the mold. Front and back walls 102, 104, and base top walls 106, 108 collectively form base mold 101.

Mold wall 114 is slightly inclined from vertical and is also formed of one-half inch (½") thick steel plate and has a length equal to the length of the module. It is mounted along the inboard extent of first, sea-side base top wall 106. Mold wall 116 is also slightly inclined from vertical and is formed of one-half inch (½") thick steel plate as well and is mounted along the inboard extent of second, ground-side base top wall 108. Mold walls 114 and 116 are preferably forty eight inches (48") in height. The slight incline of said mold walls 114, 116 positions the lower end of each wall about an inch closer to the sea side or the ground side, respectively, than the top end of each mold wall. In other words, the slope is about one inch (1") in depth or width for forty eight inches (48") in height.

A plurality of stiffener rods or dowels, collectively denoted 118, is employed to prevent each base top wall 106, 108 from swinging open when mold 100 is filled with concrete. Accordingly, a plurality of stiffener or dowel housings, collectively denoted 120, is formed in or attached to the top surface of said base top wall 106 in laterally spaced apart, parallel relation to one another and a number of stiffener housings is formed in the top surface of base top wall 108 in laterally spaced apart, parallel relation to one another. Each dowel housing 120 formed in or attached to base top wall 106 is in longitudinal alignment with a dowel housing 120 formed in or attached to base top wall 108. A first dowel 118 having a length in excess of thirty nine inches (39") is therefore slideably inserted through first longitudinally aligned dowel housings 120 of base top walls 106, 108, and a second dowel 118 having the same length is slideably inserted through second longitudinally aligned dowel housings 120, and so on until a plurality of dowels 118 has been inserted into their respective housings 120. In the depicted embodiment, there are five (5) of such dowels but that is not a critical number.

It will be observed that dowels 118 extend through the upstanding seawall mold. The dowels are removed after the curing process ends so that bores are formed in the finished seawall. These bores form weep holes that drain the seawall as required.

Steel bulkheads of this second embodiment have the same structure and perform the same function as the steel bulkheads 90 of the first embodiment. However, the sea-side and ground-side base top walls 106, 108 are not bolted to the bulkheads, as in the first mold embodiment, so that said base top walls may swing about their respective hinges.

When the concrete has cured and mold 100 is no longer needed, dowels 118 are withdrawn from dowel housings 120, the sea-side and ground-side base top walls 106 and 108 are opened by pivoting around their respective piano hinges 110, 112 as depicted in FIG. 8, vertical sea-retaining wall molds 114, 116 are removed and the cured seawall module is lifted from mold 100. Eye hooks or other suitable attachment members may be inserted into the concrete before it cures as disclosed in detail in connection with the first mold embodiment so that the module can be lifted and transported by a device that releasably engages said attachment members.

The preferred construction materials have been referred to herein as concrete but the scope of the invention includes the use of any cementitious material. Accordingly, the term "concrete" in the claims that follow shall be interpreted as any cementitious material. Those skilled in the art of materials will also recognize that non-cementitious materials may also prove to be suitable. The term "concrete" in the claims shall therefore be interpreted to include both cementitious as well as non-cementitious materials because the invention resides in the novel mold that produces a novel module lacking brace walls, and the material used to fill the novel mold to produce the novel module is not a critical component of the invention. It follows that the use of any cementitious or equivalent non-cementitious material is within the scope of this invention if the novel mold is used.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A module forming a modular part of a seawall, comprising:

a base having a generally parallelepiped configuration;

said base having a substantially solid concrete construction including a substantially flat, horizontal bottom wall, a sea-side front wall, a ground-side back wall, a substantially horizontal sea-side base top wall, a substantially horizontal ground-side base top wall, and a substantially vertical end wall at each end of said base;

an upstanding sea-retaining wall formed integrally with and disposed perpendicular to said base;

said upstanding sea-retaining wall having a generally parallelepiped construction;

said upstanding sea-retaining wall having a substantially solid concrete construction and including a sea-side front wall, a ground-side back wall, a top wall interconnecting respective top edges of said front and back walls, and a substantially vertical end wall at each end of said sea-retaining wall, said substantially vertical end walls of said base and said substantially vertical end walls of said sea-retaining wall at a first end of said module being formed integrally with one another and said substantially vertical end walls of said base and said substantially vertical end walls of said sea-retaining wall at a second end of said module being formed integrally with one another;

said upstanding sea-retaining wall being set back a predetermined distance from said front wall of said base;

a substantially vertically-extending groove formed in each substantially vertical end wall of said module;

a substantially vertically extending flat tongue adapted to slidingly fit within substantially vertically-extending grooves of contiguous modules, disposed in end-to-end relation to one another, to interlock said contiguous modules and to prevent flow of water and earth between said contiguous modules;

a recess of predetermined depth and height formed in said front wall of said upstanding sea-retaining wall, said recess having a length equal to a length of said module;

said recess being in open communication with said top wall of said upstanding sea-retaining wall and forming a flat horizontal support ledge a predetermined distance below said top wall;

said recess adapted to accommodate and support an elongate, flat strip of material that is positioned on edge within said recess and supported by said flat horizontal support ledge;

said elongate, flat strip of material having a thickness substantially equal to said depth of said recess, a length at least equal to said length of said recess, and a height exceeding a height of said recess, said flat strip of material extending above said top wall of said upstanding sea wall;

said height of said flat, elongate strip of material extending above said top wall by a distance substantially equal to a sidewalk thickness so that said elongate, flat strip of material is adapted to provide a sea-side frame for a sidewalk that extends along the extent of said seawall on a ground side thereof;

a first set of rebars embedded in said module; and each rebar of said first set of rebars having a first gradual ninety degree bend formed therein so that a horizontal section is embedded in a ground-side of said base, a vertical section has a lower part embedded in said upstanding sea-retaining wall and an upper part extending above said top wall of said upstanding sea-retaining wall by a distance slightly greater than a width of sidewalk, a second ninety degree bend formed in said upper part slightly above said top wall of said upstanding sea-retaining wall, said second gradual ninety degree bend positioning said upper part so that it extends substantially perpendicular to said upstanding seawall in a around-side direction and horizontally by a distance substantially equal to the width of said sidewalk so that said upper part is adapted to be embedded in said sidewalk.

2. The module of claim 1, further comprising:

said predetermined distance being less than half of a distance from said inclined front wall of said base to said inclined back wall of said base.

3. The module of claim 1, further comprising:

a second set of rebars embedded in said module;

each rebar of said second set of rebars having a ninety degree bend formed therein so that a horizontal section of each rebar is embedded in a sea-side of said base and so that a vertical section of each rebar is embedded in said upstanding sea-retaining wall, and an upper end of each rebar is substantially flush with said top wall of said upstanding sea-retaining wall.

4. The module of claim 3, further comprising:

at least one "U"-shaped rebar having a first end embedded in concrete and secured to a preselected rebar of said first set of rebars, a second end embedded in concrete and secured to a preselected rebar of said second set of rebars, and a bight end disposed above said top wall of said upstanding sea wall;

said bight end adapted to be engaged by a device capable of lifting said module from a support surface and transporting said module to a preselected position that said module occupies when forming a part of a seawall formed of a plurality of said modules.

5. The module of claim 1, further comprising:

at least one attachment member embedded in said module and projecting upwardly from said top wall of said sea-retaining wall, said at least one attachment member adapted to be engaged by a device capable of lifting said module from a support surface and transporting said module to a preselected position that said module occupies when forming a part of a seawall formed of a plurality of said modules.

* * * * *